US006347472B1

(12) United States Patent
Dominguez

(10) Patent No.: US 6,347,472 B1
(45) Date of Patent: Feb. 19, 2002

(54) FRAMED MIRROR WITH MEANS FOR ATTACHMENT OF PERSONAL ITEMS

(76) Inventor: Ana M. Dominguez, 1620 Skytop Garden, Parlin, NJ (US) 08859

( * ) Notice: Subject to any disclaimer, the term of this patent is extended or adjusted under 35 U.S.C. 154(b) by 0 days.

(21) Appl. No.: 09/667,462

(22) Filed: Sep. 22, 2000

(51) Int. Cl.[7] ..... A47G 1/16; G09F 7/06
(52) U.S. Cl. ..... 40/729; 40/799; 40/605
(58) Field of Search ..... 40/729, 798, 799, 40/605; D6/300–302; 248/488, 918, 442.2; 52/785.1

(56) References Cited

U.S. PATENT DOCUMENTS 3,722,121 A * 3/1973 Olczewski ..... 40/799
4,123,862 A * 11/1978 Dyer et al. ..... 40/729
4,532,727 A * 8/1985 Klose et al. ..... 40/729
5,549,267 A * 8/1996 Armbruster et al. ..... 248/918

* cited by examiner

*Primary Examiner*—Cassandra H. Davis
(74) *Attorney, Agent, or Firm*—Goldstein Law Offices, P.C.

(57) ABSTRACT

A framed mirror with means for attachment of personal items including a frame member comprised of an outer periphery disposed around a hollow interior. The hollow interior has a mirror portion disposed therein. The outer periphery has a plurality of apertures therein in a spaced relationship extending around an entirety of the outer periphery. A plurality of securement strips are provided with each being adapted for securement to the outer periphery of the frame member. The securement strips each have a front surface and a back surface. The back surface has at least one protrusion extending outwardly therefrom for being received within the apertures of the outer periphery of the frame member in an engaged orientation. The front surface has securement means thereon.

5 Claims, 2 Drawing Sheets

FRAMED MIRROR WITH MEANS FOR ATTACHMENT OF PERSONAL ITEMS

BACKGROUND OF THE INVENTION

The present invention relates to a framed mirror with means for attachment of personal items and more particularly pertains to allowing a variety of personal items to be secured in view of a person using the mirror.

People spend a significant amount of time in front of mirrors checking their appearance. Frequently, people adorn their mirrors with various objects, such as pictures of their children or significant others. Typically, these pictures and other decorative items are secured to the mirror using cellophane tape or other adhesive type of securement means. Sometimes these items will become detached from the mirror or the tape that holds the items in place will create a messy appearance on the mirror. Thus, what is needed is a way to secure various personal items to a framed mirror in order to spruce of the appearance of the mirror and not make a mess of the mirror.

The present invention attempts to solve the abovementioned problem by providing a device that includes a framed mirror that allows personal items to be secured to and removed from the mirror in a simple, and easy manner.

The use of framed mirrors is known in the prior art. More specifically, framed mirrors heretofore devised and utilized for the purpose of allowing a person to see their image are known to consist basically of familiar, expected and obvious structural configurations, notwithstanding the myriad of designs encompassed by the crowded prior art which have been developed for the fulfillment of countless objectives and requirements.

While these devices fulfill their respective, particular objective and requirements, these patents do not describe a framed mirror with means for attachment of personal items for allowing a variety of personal items to be secured in view of a person using the mirror.

In this respect, the framed mirror with means for attachment of personal items according to the present invention substantially departs from the conventional concepts and designs of the prior art, and in doing so provides an apparatus primarily developed for the purpose of allowing a variety of personal items to be secured in view of a person using the mirror.

Therefore, it can be appreciated that there exists a continuing need for a new and improved framed mirror with means for attachment of personal items which can be used for allowing a variety of personal items to be secured in view of a person using the mirror. In this regard, the present invention substantially fulfills this need.

SUMMARY OF THE INVENTION

In the view of the foregoing disadvantages inherent in the known types of framed mirrors now present in the prior art, the present invention provides an improved framed mirror with means for attachment of personal items. As such, the general purpose of the present invention, which will be described subsequently in greater detail, is to provide a new and improved framed mirror with means for attachment of personal items which has all the advantages of the prior art and none of the disadvantages.

To attain this, the present invention essentially comprises a frame member comprised of an outer periphery disposed around a hollow interior. The hollow interior has a mirror portion disposed therein. The outer periphery has a plurality of apertures therein in a spaced relationship extending around an entirety of the outer periphery. A plurality of securement strips are provided with each being adapted for securement to the outer periphery of the frame member. The securement strips each have a front surface and a back surface. The back surface has at least one protrusion extending outwardly therefrom for being received within the apertures of the outer periphery of the frame member in an engaged orientation. The front surface has securement means thereon. A plurality of objects are provided with each being adapted for securement to the outer periphery of the frame member. Each object has a back surface with at least one protrusion extending outwardly therefrom for being received within the apertures of the outer periphery of the frame member in an engaged orientation.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved framed mirror with means for attachment of personal items which has all the advantages of the prior art framed mirrors and none of the disadvantages.

It is another object of the present invention to provide a new and improved framed mirror with means for attachment of personal items which may be easily and efficiently manufactured and marketed.

It is a further object of the present invention to provide a new and improved framed mirror with means for attachment of personal items which is of durable and reliable construction.

An even further object of the present invention is to provide a new and improved framed mirror with means for attachment of personal items which is susceptible of a low cost of manufacture with regard to both materials and labor, and which accordingly is then susceptible of low prices of sale to the consuming public, thereby making such a framed mirror with means for attachment of personal items economically available to the buying public.

Even still another object of the present invention is to provide a new and improved framed mirror with means for attachment of personal items for allowing a variety of personal items to be secured in view of a person using the mirror.

Lastly, it is an object of the present invention to provide a new and improved framed mirror with means for attachment of personal items including a frame member comprised of an outer periphery disposed around a hollow interior. The hollow interior has a mirror portion disposed therein. The outer periphery has a plurality of apertures therein in a spaced relationship extending around an entirety of the outer periphery. A plurality of securement strips are provided with each being adapted for securement to the outer periphery of the frame member. The securement strips each have a front surface and a back surface. The back surface has at least one protrusion extending outwardly therefrom for being received within the apertures of the outer periphery of the frame member in an engaged orientation. The front surface has securement means thereon.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various FIGURES.

DESCRIPTION OF THE PREFERRED EMBODIMENT

Figure 1:
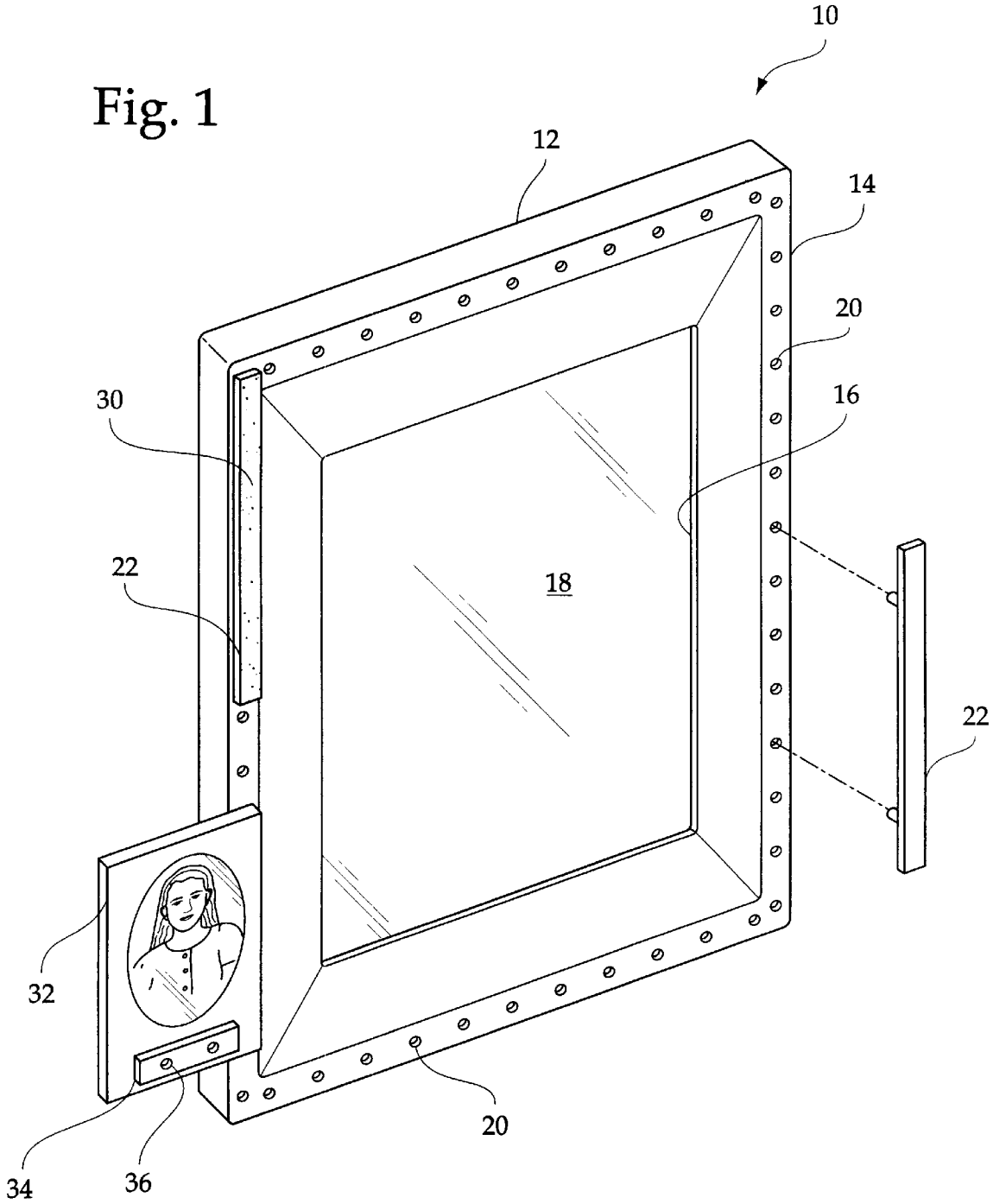
FIG. 1 is a perspective view of the preferred embodiment of the framed mirror with means for attachment of personal items constructed in accordance with the principles of the present invention.
Figure 3:
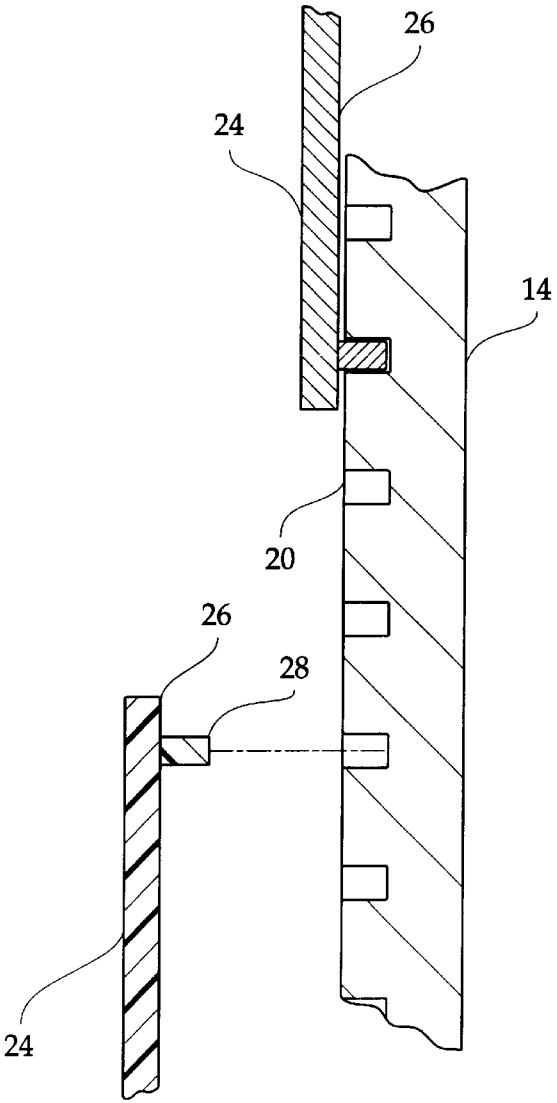
FIG. 3 is a partial side view of the present invention.
Figure 2:
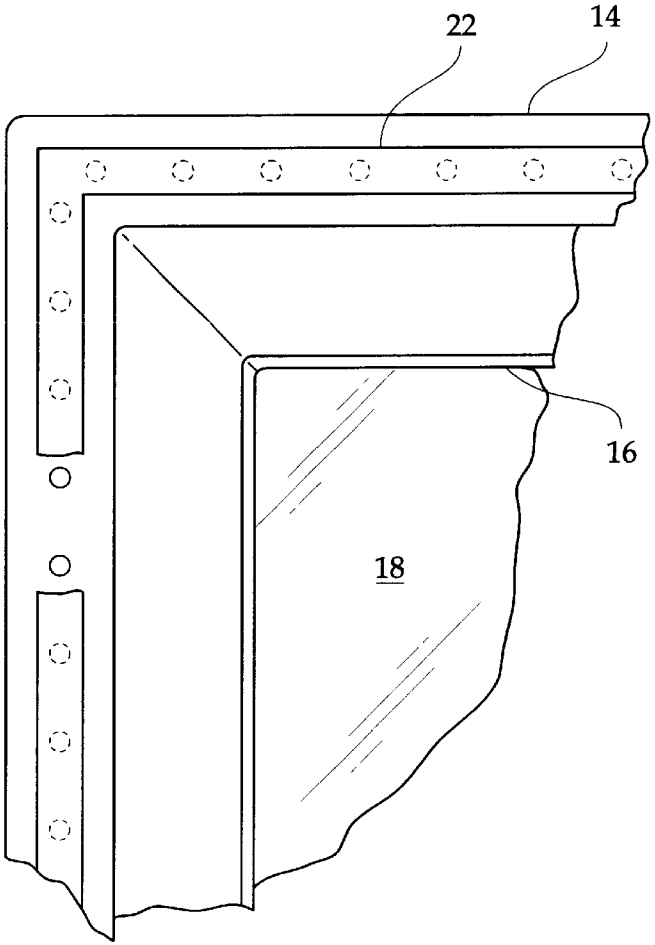
FIG. 2 is a partial front view of the present invention.

With reference now to the drawings, and in particular, to FIGS. 1 through 3 thereof, the preferred embodiment of the new and improved framed mirror with means for attachment of personal items embodying the principles and concepts of the present invention and generally designated by the reference number will be described.

Specifically, it will be noted in the various figures that the device relates to a framed mirror with means for attachment of personal items for allowing a variety of personal items to be secured in view of a person using the mirror. In its broadest context, the device consists of a frame member, a plurality of securement strips, and a plurality of objects. Such components are individually configured and correlated with respect to each other so as to attain the desired objective.

The frame member 12 is comprised of an outer periphery 14 disposed around a hollow interior 16. The hollow interior 16 has a mirror portion 18 disposed therein. Alternately, the hollow interior 16 can contain other items therein, such as art prints or photographs. The outer periphery 14 has a plurality of apertures 20 therein in a spaced relationship extending around an entirety of the outer periphery 14. Typically, the apertures 20 will be spaced two inches apart. The frame member 12, as illustrated in FIG. 1, has a rectangular configuration. It should also be noted that the frame member 12 can be configured in any desired shape that are normally associated with framed mirrors found in the art.

The plurality of securement strips 22 are adapted for securement to the outer periphery 14 of the frame member 12. The securement strips 22 each have a front surface 24 and a back surface 26. The back surface 26 has at least one protrusion 28 extending outwardly therefrom for being received within the apertures 20 of the outer periphery 14 of the frame member 12 in an engaged orientation. The front surface 24 has securement means 30 thereon. The securement strips 22 can come in a variety of shapes and lengths. FIG. 1 illustrates the use of straight strips. FIG. 2 illustrates the use of L-shaped strips. The securement means 30 utilized by the present invention is suggested to include hook and loop fasteners and magnetic.

The plurality of objects 32 are adapted for securement to the outer periphery 14 of the frame member 12. Each object 32 has a back surface with at least one protrusion 28 extending outwardly therefrom for being received within the apertures 20 of the outer periphery 14 of the frame member 12 in an engaged orientation. The plurality of objects 32 include, but are not limited to, small make-up mirrors, framed photographs, implement holders, a jewelry cabinet, clocks, and key holders. FIG. 1 illustrates the use of the framed photograph secured to the outer periphery of the frame member. It should be noted that the framed photograph also includes a strip 34 thereon that includes a pair of apertures 36 to allow for other objects to be secured thereto.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A framed mirror with means for attachment of personal items for allowing a variety of personal items to be secured in view of a person using the mirror, the present invention comprising, in combination:

a frame member comprised of an outer periphery disposed around a hollow interior, the hollow interior having a mirror portion disposed therein, the outer periphery having a plurality of apertures therein in a spaced relationship extending around an entirety of the outer periphery;

a plurality of securement strips each being adapted for securement to the outer periphery of the frame member, the securement strips each having a front surface and a back surface, the back surface having at least one protrusion extending outwardly therefrom for being received within the apertures of the outer periphery of the frame member in an engaged orientation, the front surface having securement means thereon; and a plurality of objects each being adapted for securement to the outer periphery of the frame member, each object having a back surface with at least one protrusion extending outwardly therefrom for being received within the apertures of the outer periphery of the frame member in an engaged orientation.

2. The framed mirror with means for attachment of personal items as set forth in claim 1, wherein the securement means of the plurality of securement strips includes hook and loop fasteners.

3. The framed mirror with means for attachment of personal items as set forth in claim 1, wherein the securement means of the plurality of securement strips includes magnetic properties.

4. A frame with means for attachment of personal items for allowing a variety of personal items to be secured in view of a person, the present invention comprising, in combination:

a frame member comprised of an outer periphery disposed around a hollow interior, the outer periphery having a plurality of apertures therein in a spaced relationship extending around an entirety of the outer periphery; and a plurality of securement strips each being adapted for securement to the outer periphery of the frame member, the securement strips each having a front surface and a back surface, the back surface having at least one protrusion extending outwardly therefrom for being received within the apertures of the outer periphery of the frame member in an engaged orientation, the front surface having securement means thereon.

5. The framed mirror with means for attachment of personal items as set forth in claim 4 and further including a plurality of objects each being adapted for securement to the outer periphery of the frame member, each object having a back surface with at least one protrusion extending outwardly therefrom for being received within the apertures of the outer periphery of the frame member in an engaged orientation.

* * * * *